US008070517B2

(12) United States Patent
Xiong et al.

(10) Patent No.: US 8,070,517 B2
(45) Date of Patent: Dec. 6, 2011

(54) ELECTRICAL CONNECTOR HAVING AN IMPROVED SPRING MEMBER FOR ABUTTING AGAINST A METAL PLATE

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 301 days.

(21) Appl. No.: 12/540,592

(22) Filed: Aug. 13, 2009

(65) Prior Publication Data

US 2010/0093215 A1 Apr. 15, 2010

(30) Foreign Application Priority Data

Oct. 15, 2008 (CN) ..... 2008 2 0302434

(51) Int. Cl.
*H01R 13/648* (2006.01)

(52) U.S. Cl. ..... 439/607.28; 439/939

(58) Field of Classification Search ..... 439/607.19, 439/607.28, 939, 607.4
See application file for complete search history.

(56) References Cited

U.S. PATENT DOCUMENTS 6,478,622 B1 * 11/2002 Hwang ..... 439/607.2
6,533,612 B1 * 3/2003 Lee et al. ..... 439/564
7,090,540 B2 8/2006 Masumoto et al.
7,455,554 B2 * 11/2008 Long ..... 439/607.17

* cited by examiner

*Primary Examiner* — Tulsidas C Patel
*Assistant Examiner* — Travis Chambers
(74) *Attorney, Agent, or Firm* — Wei Te Chung; Andrew C. Cheng; Ming Chieh Chang

(57) ABSTRACT

An electrical connector for abutting against a metal plate, comprises an insulative housing defining a main body and a tongue plate extending forwardly from the main body, a plurality of terminals retained in the main body and extending into the tongue plate, a metal shell shielding the insulative housing and comprising an upper wall, a pair of side walls extending downwardly from two lateral sides of the upper wall, and a bottom wall in parallel with the upper wall, and a spring member defining a securing portion fixed to the shell and a resilient resisting portion abutting against the metal plate. The securing portion defines a ceiling plate portion shielding the fingers on the upper wall, and a pair of side plate portions extending downwardly from two lateral sides of the ceiling plate portion and shielding the fingers on the respective side walls.

14 Claims, 5 Drawing Sheets

ELECTRICAL CONNECTOR HAVING AN IMPROVED SPRING MEMBER FOR ABUTTING AGAINST A METAL PLATE

BACKGROUND OF THE INVENTION

1. Field of the Invention

The present invention generally relates to an electrical connector for mounting on a Printed Circuit Board (PCB) and more particularly to an electrical connector abutting against a metal plate.

2. Description of Related Art

A conventional electrical connector for mounting on a PCB usually comprises an insulative housing, a plurality of terminals retained therein, and a shell shielding the insulative housing. The shell includes a polygonal portion surrounding the insulative housing and a fixing portion extending from the polygonal portion. The fixing portion has a through hole formed thereon for a rivet passing therethrough. the fixing portion are fastened to a metal plate via the rivet so as to electrically connect to the metal plate for electrostatic discharge (ESD).

However, the electrical connection between the shell and the metal plate must be realized via a rivet. The step of the rivet installation will complicate the assembly processes, and the production of the rivet will increase the manufacturing costs.

Hence, an improvement over the prior art is required to overcome the problems thereof.

SUMMARY OF THE INVENTION

According to one aspect of the present invention, an electrical connector for abutting against a metal plate, comprises an insulative housing defining a main body and a tongue plate extending forwardly from the main body, a plurality of terminals retained in the main body and extending into the tongue plate, a metal shell shielding the insulative housing to form a receiving room to accommodate a mating plug and comprising an upper wall, a pair of side walls extending downwardly from two lateral sides of the upper wall, and a bottom wall in parallel with the upper wall, and a spring member defining a securing portion fixed to the shell and a resilient resisting portion to abut against the metal plate. A plurality of deflectable fingers are formed on the upper wall, the side walls and the bottom wall to extend into the receiving room. The securing portion defines a ceiling plate portion shielding the fingers on the upper wall, and a pair of side plate portions extending downwardly from two lateral sides of the ceiling plate portion and shielding the fingers on the respective side walls.

According to another aspect of the present invention, an electrical connector for abutting against a metal plate, comprises an insulative housing defining a main body and a tongue plate extending forwardly from the main body, a plurality of terminals having positioning portions retained in the main body, contacting portions extending forwardly from front ends of the positioning portions and retained in the tongue plate, and tail portions extending downwardly from rear ends of the positioning portions, a metal shell shielding the insulative housing and comprising an upper wall, a pair of side walls extending downwardly from two lateral sides of the upper wall, and a bottom wall in parallel with the upper wall, and a grouding spring member defining a securing portion fixed to the shell and a resilient resisting portion abutting against the metal plate. The securing portion defines a ceiling plate portion extending above and in parallel with the upper wall, and a pair of side plate portions extending downwardly from two lateral sides of the ceiling plate portion. The resisting portion comprises a first resisting portion extending from the ceiling plate portion and a pair of second resisting portions extending from the side plate portions.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
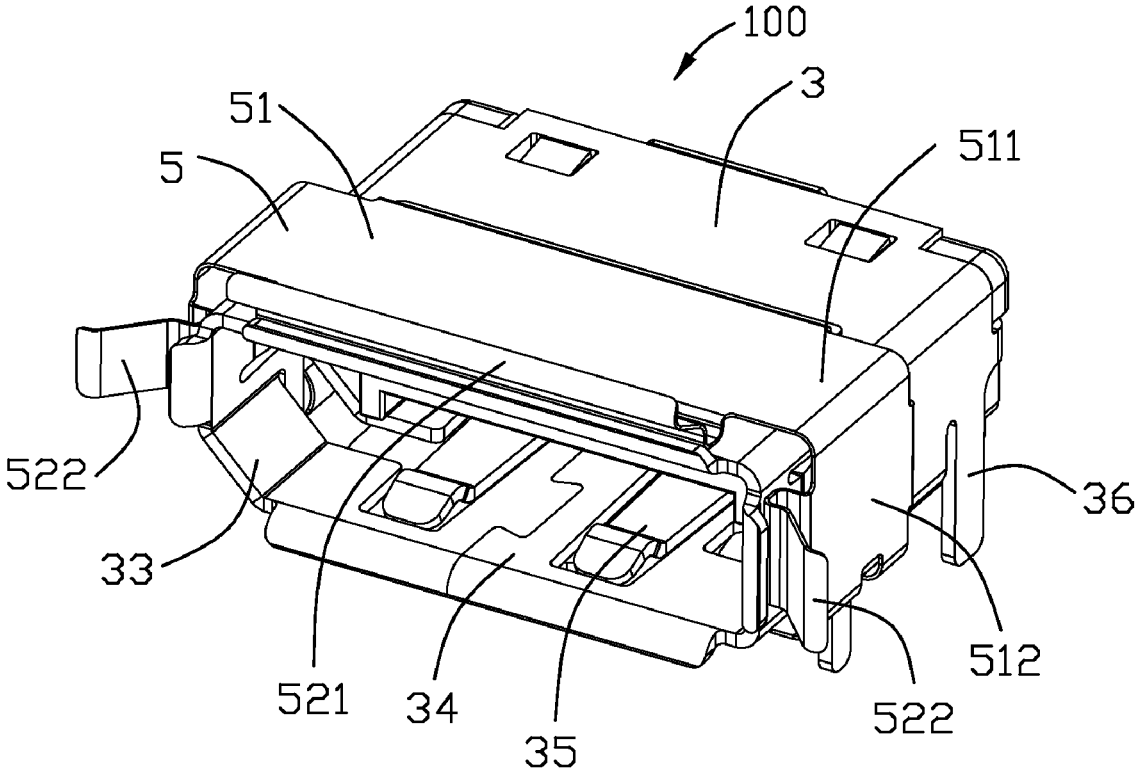
FIG. 1 is a perspective view of an electrical connector according to the present invention.
Figure 2:
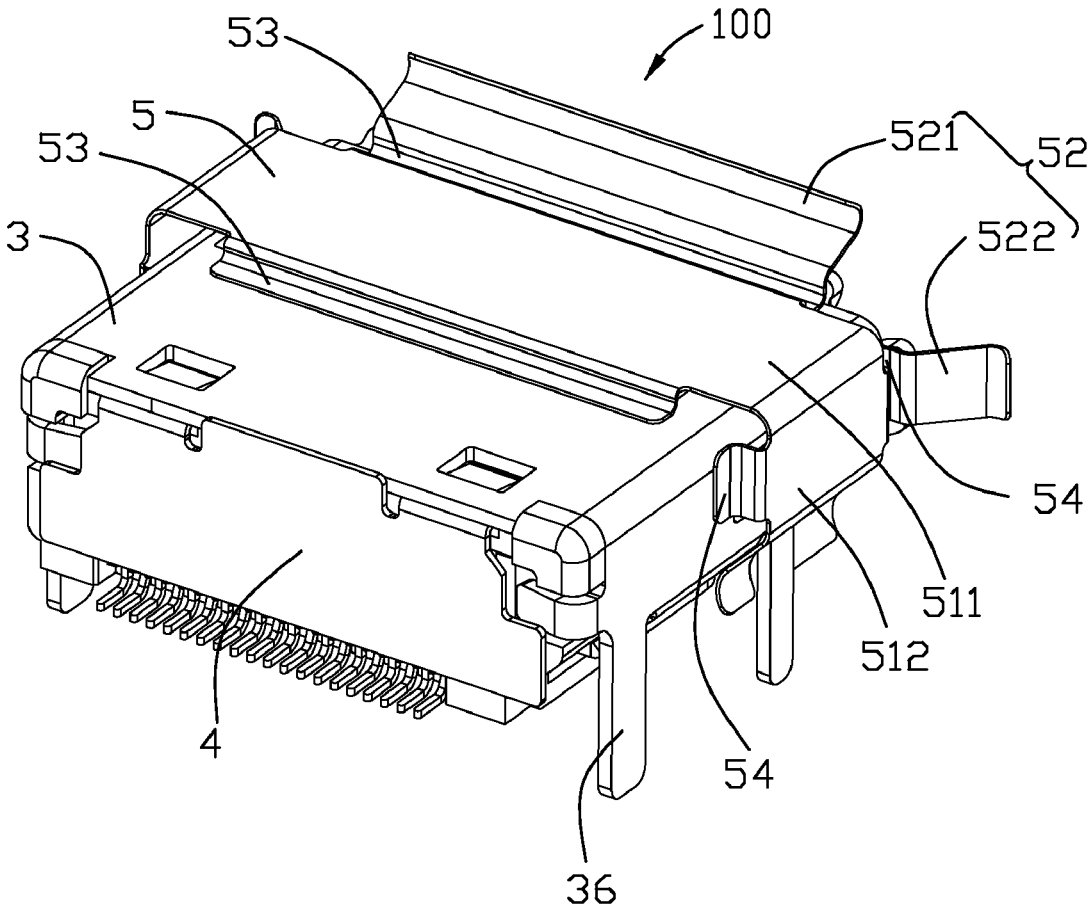
FIG. 2 is an another perspective view of the electrical connector shown in FIG. 1.
Figure 3:
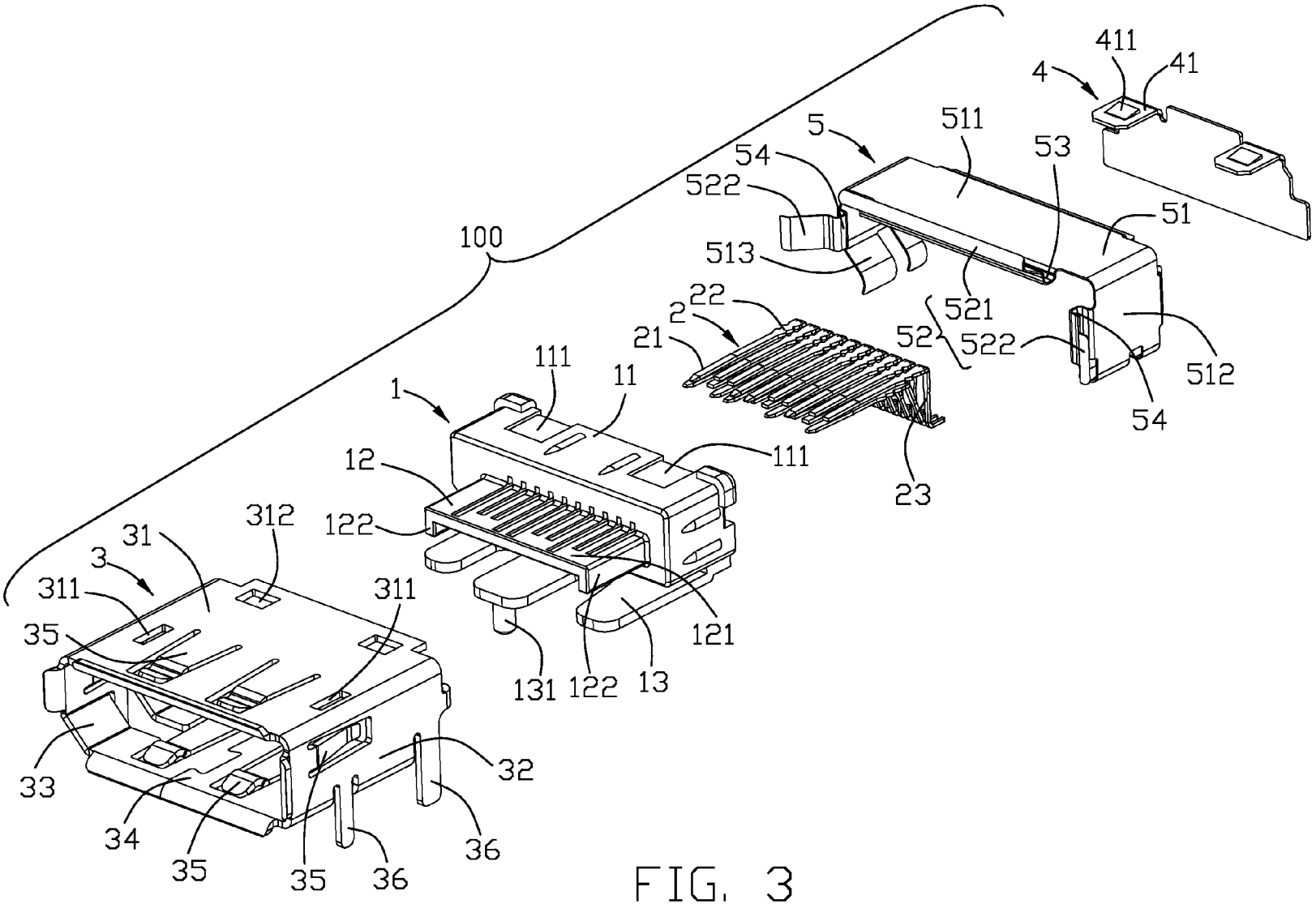
FIG. 3 is an exploded view of the electrical connector shown in FIG. 1.

Reference will now be made to the drawing figures to describe the preferred embodiment of the present invention in detail.

Figure 4:
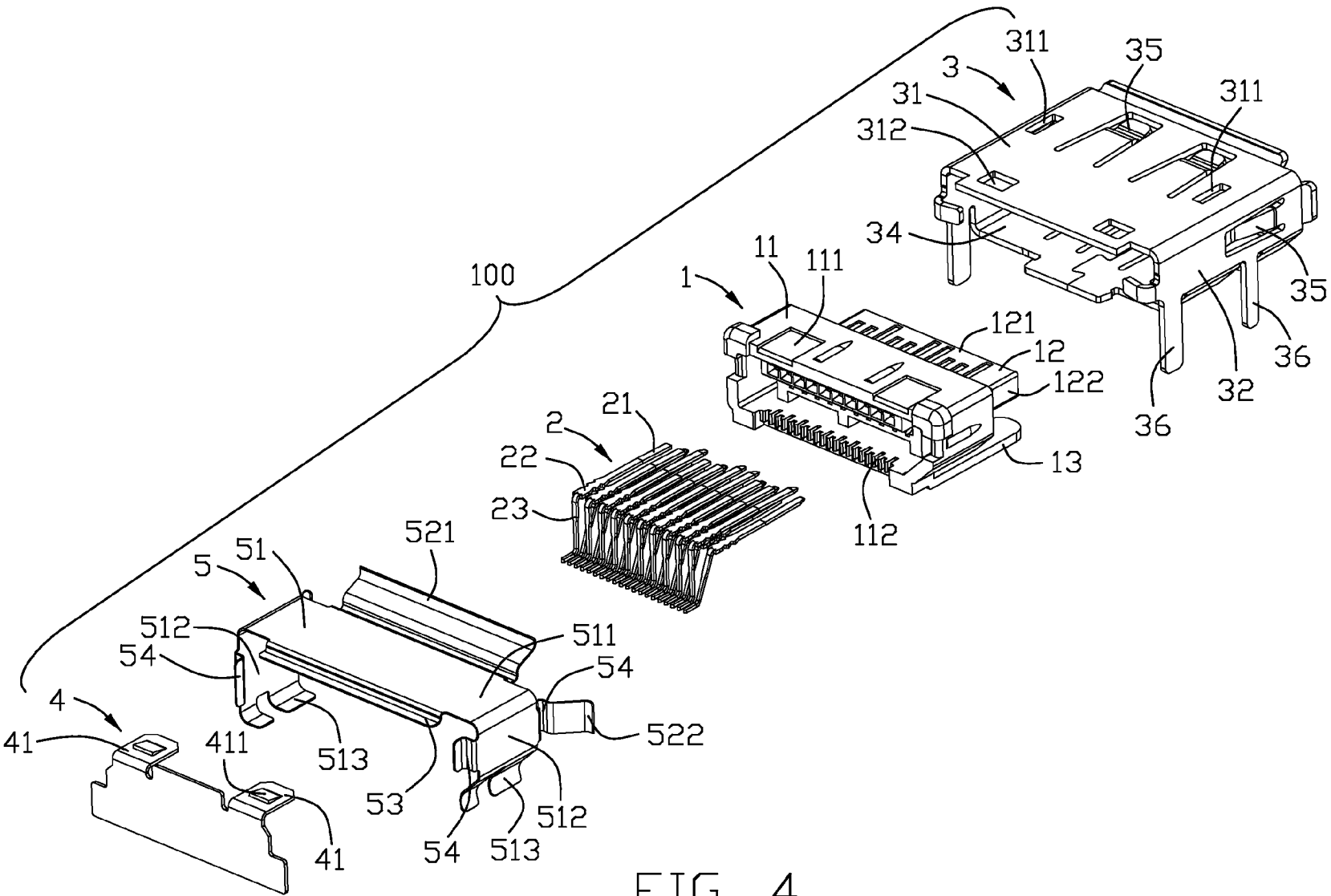
FIG. 4 is an another exploded view of the electrical connector shown in FIG. 1.
Figure 5:
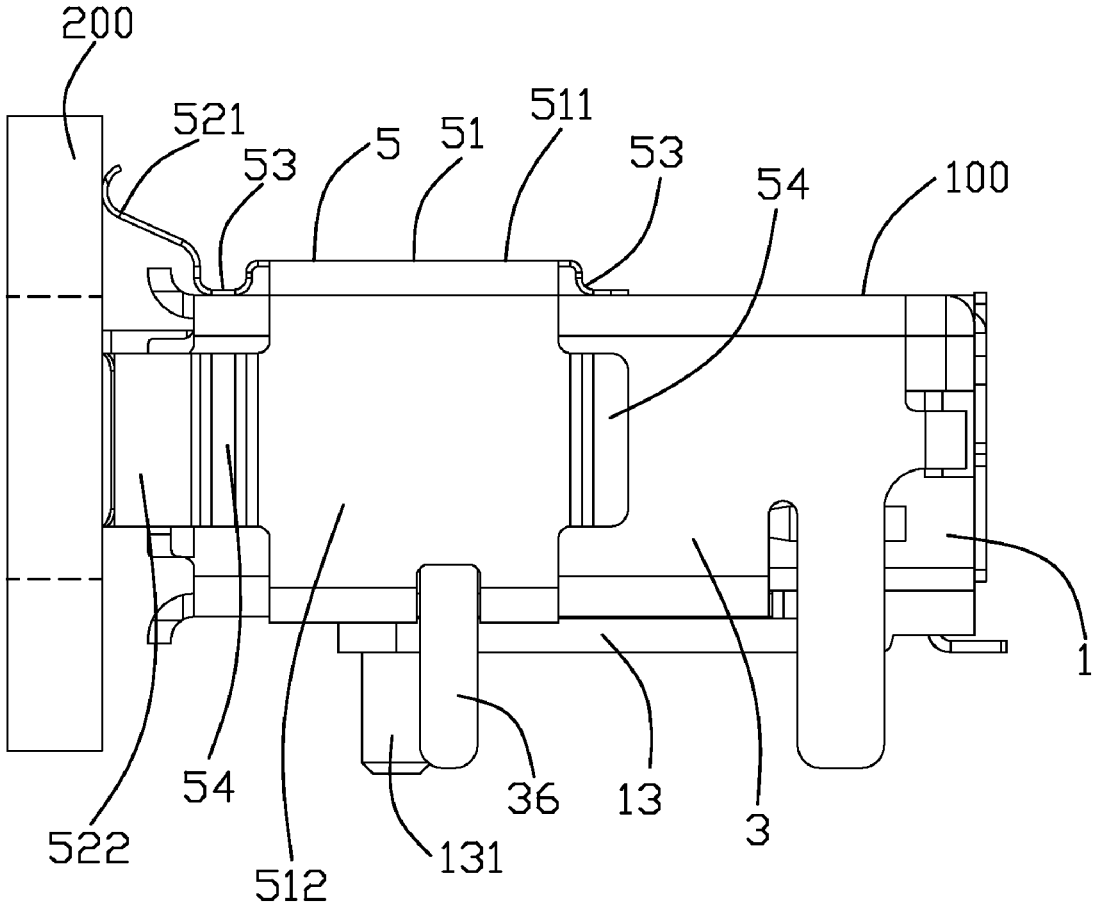
FIG. 5 is a view showing the electrical connector abutting against a metal plate.

Referring to FIGS. 1, 4 and 5, an electrical connector 100 can abut against a metal plate 200 of a computer case or else according to the present invention. The electrical connector 100 described in this preferred embodiment is compatible to a Displayport plug and comprises an insulative housing 1, a plurality of terminals 2 retained in the insulative housing 1, a metal shell 3 covering the insulative housing 1, a rear cover 4 coupled to the metal shell 3, and a spring member 5 retained on the metal shell 3 and abutting against the metal plate 200.

Referring to FIGS. 4 and 5, the insulative housing 1 includes a main body 11, a tongue plate 12 extending forwardly from a front end of the main body 11 and a bottom plate 13 extending forwardly from a lower portion of the main body 11. The tongue plate 12 and the bottom plate 13 are spaced from each other along a height direction of the insulative housing 1. A post 131 extends downwardly from the bottom plate 13 to be retained on a Printed Circuit Board (PCB). The main body 11 has a pair of receiving slot 111 on an upper surface thereof and a number of cavities 112 on a rear end thereof. The tongue plate 12 has a horizontal portion 121 and a pair of vertical portions 122 extending from two lateral sides of the horizontal portion 121 and along a direction perpendicular to the horizontal portion 121.

Each terminal 2 has a positioning portion 22 retained in the main body 11, a contacting portion 21 extending forwardly from a front end of the positioning portion 22, and a tail portion 23 extending downwardly from a rear end of the positioning portion 22 and bending backwardly at a proper position to be mounted on the PCB. The contacting portions 21 are arranged in upper and lower sides of the tongue plate 12. The tail portion 23 are arranged in one row and retained in the cavities 112 of the main body 11.

The shell 3 has an upper wall 31, a pair of side walls 32 extending downwardly from two lateral sides of the upper wall 31, a bottom wall 34 in parallel with the upper wall 31 and supported by the bottom plate 13, and a inclined wall 33 interconnecting the bottom wall 34 and one of the side walls 32 and extending obliquely at a predetermined angle. A number of fingers 35 are stamped by the upper wall 31, the side walls 32 and the bottom wall 34 and extend along a front-rear direction. The upper wall 31 has a pair of apertures 311 formed thereon for retaining a pair of latches of a plug (not shown) therein and a pair of perforations 312 formed on a rear portion thereof. Each side wall 32 has a pair of legs 36 extending downwardly therefrom to be retained in the PCB.

The cover 4 covers the rear end of the main body 11 and has a pair of tabs 41 extending forwardly from an upper sides thereof to be received in the receiving slots 111. Each tab 41 forms a protrusion 411 latching in the respective perforation 312 of the shell 31. Therefore, the shell 3 and the cover 4 are assembled together to prevent Electro-Magnetic Interference (EMI).

Referring to FIGS. 1-5, the spring member 5 includes a securing portion 51 fixed to the shell 3 and a resilient resisting portion 52 abutting against the metal plate 200. The securing portion 51 includes a ceiling plate portion 511 in parallel with the upper wall 31, a pair of side plate portions 512 extending from two lateral sides of the ceiling plate portions 511, and a pair of bending portions 513 extending inwardly from lower ends of the respective side plate portions 512. The ceiling plate portion 511 and the side plate portions 512 could shied apertures 311 and clearances formed by stamping the fingers 35 from the upper wall 31 or the side walls 32 and around the fingers 35 so as to reduce EMI more effectively. A pair of first standing portions 53 extend downwardly from front and rear ends of the ceiling plate portion 511 respectively. The standing portions 53 press against the upper wall 31 so as to form a room between the ceiling plate portion 511 and the upper wall 31 to allow for deformations of the fingers 35 on the upper wall 31. A pair of second standing portions 54 extend forwardly from front and rear ends of each side plate portion 512. The second standing portions 54 press against the respective side walls 32 so as to form rooms between the side plate portions 512 and the side walls 32 to allow for deformations of the fingers 35 on the side walls 32. The resilient resisting portion 52 includes a first resisting portion 521 extending slantwise forwardly and upwardly at a predetermined angle from the first standing portion 53 and a pair of second resisting portions 522 extending slantwise forwardly and outwardly at predetermined angles from the respective second standing portions 54. One of the bending portions 513 extends horizontally and inwardly to latch on the bottom wall 34, and the other bending portion 513 extends inwardly at a predetermined angle and latches on the inclined wall 33. Therefore, the spring member 5 could be fixed to the shell 3 firmly. In an alternative embodiment of the present invention, the first and second standing portions 53, 54 could be soldered on the respective upper and side walls 31, 32.

Referring to FIGS. 5, the electrical connector 100 forms the first and second resisting portions 521, 522 abutting against the metal plate 200 to electrically connect with the metal plate 200 for Electrostatic Discharge (ESD). Therefore, the electrical connector 100 has a simple structure for electrical connection to the metal plate and will be easily assembled to the metal plate. Furthermore, the first and second resisting portions 521, 522 will enhance electrical connection with the metal plate 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for abutting against a metal plate, comprising:

an insulative housing defining a main body and a tongue plate extending forwardly from the main body;

a plurality of terminals retained in the main body and extending into the tongue plate;

a metal shell shielding the insulative housing to form a receiving room to accommodate a mating plug and comprising an upper wall, a pair of side walls extending downwardly from two lateral sides of the upper wall, and a bottom wall in parallel with the upper wall, a plurality of deflectable fingers being formed on the upper wall, the side walls, and the bottom wall to extend into the receiving room;

a spring member defining a securing portion fixed to the shell and a resilient resisting portion to abut against the metal plate, the securing portion defining a ceiling plate portion shielding the fingers on the upper wall, and a pair of side plate portions extending downwardly from two lateral sides of the ceiling plate portion and shielding the fingers on the respective side walls; and wherein the ceiling plate portion has a pair of first standing portions extending from front and rear ends thereof respectively and pressing against the upper wall to form a room between the ceiling plate portion and the upper wall to allow for deformations of the fingers on the upper wall.

2. The electrical connector as claimed in claim 1, wherein the resisting portion comprises a first resisting portion extending slantwise forwardly and upwardly at a predetermined angle from the first standing portion to abut against the metal plate.

3. The electrical connector as claimed in claim 1, wherein the shell further comprises a inclined wall interconnecting the bottom wall and one of the side walls, the securing portion further defines a pair of bending portions extending from lower ends of the side plate portions, the bending portions latch on the respective bottom wall and the inclined wall.

4. The electrical connector as claimed in claim 1, wherein the upper wall has a pair of apertures at two lateral sides of the fingers on the upper wall to retain a pair of latches of a plug and being shielded by the ceiling plate portion.

5. The electrical connector as claimed in claim 1, wherein the tongue plate has a horizontal portion and a pair of vertical portions extending from two lateral sides of the horizontal portion and along a direction perpendicular to the horizontal portion.

6. The electrical connector as claimed in claim 1, wherein the electrical connector further comprises a cover covering a rear end of the main body and having a pair of protrusions latched in a pair of perforations formed on the upper wall.

7. The electrical connector as claimed in claim 1, wherein the side plate portions each has a pair of second standing portions extending from front and rear ends thereof respectively to press against the respective side walls to form rooms between the side plate portions and the side walls to allow for deformations of the fingers on the side walls.

8. The electrical connector as claimed in claim 7, wherein the resisting portion comprises a pair of second resisting portions extending slantwise forwardly and outwardly at a predetermined angle from the respective second standing portions to abut against the metal plate.

9. An electrical connector for abutting against a metal plate, comprising: an insulative housing defining a main body and a tongue plate extending forwardly from the main body;

a plurality of terminals comprising positioning portions retained in the main body, contacting portions extending forwardly from front ends of the positioning portions and retained in the tongue plate, and tail portions extending downwardly from rear ends of the positioning portions;

a metal shell shielding the insulative housing and comprising an upper wall, a pair of side walls extending downwardly from two lateral sides of the upper wall, and a bottom wall in parallel with the upper wall;

a grounding spring member defining a securing portion fixed to the shell and a resilient resisting portion to abut against the metal plate, the securing portion defining a ceiling plate portion extending above and in parallel with the upper wall, and a pair of side plate portions extending downwardly from two lateral sides of the ceiling plate portion, the resisting portion comprising a first resisting portion extending from the ceiling plate portion and a pair of second resisting portions extending from the side plate portions; and wherein the ceiling plate portion has a pair of first standing portions extending from front and rear ends thereof respectively and pressing against the upper wall to form a room between the ceiling plate portion and the upper wall to allow for deformations of the fingers on the upper wall.

10. The electrical connector as claimed in claim 9, wherein the upper wall has a pair of fingers stamped therefrom and forms a plurality of clearances around the fingers and shielded by the ceiling plate portion.

11. The electrical connector as claimed in claim 9, wherein the first resisting portion extending slantwise forwardly and upwardly at a predetermined angle from the first standing portion to abut against the metal plate.

12. The electrical connector as claimed in claim 9, wherein each side wall has a finger stamped therefrom and forms clearance around the finger and shielded by the respective side plate portion.

13. The electrical connector as claimed in claim 12, wherein the side plate portions each has a pair of second standing portions extending from front and rear ends thereof and pressing against the respective side walls to form rooms between the side plate portions and the side walls to allow for deformations of the fingers on the side walls.

14. The electrical connector as claimed in claim 13, wherein the second resisting portions extending slantwise forwardly and outwardly at a predetermined angle from the respective second standing portions to abut against the metal plate.

* * * * *